US006378468B1

(12) United States Patent
Kouchi et al.

(10) Patent No.: US 6,378,468 B1
(45) Date of Patent: Apr. 30, 2002

(54) ENGINE OPERATED MACHINE

(75) Inventors: Toshifumi Kouchi; Tadafumi Hirose, both of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/613,278

(22) Filed: Jul. 10, 2000

(30) Foreign Application Priority Data

Jul. 12, 1999 (JP) ..... 11-197828

(51) Int. Cl.[7] ..... F01P 1/00
(52) U.S. Cl. ..... 123/41.56; 123/195 C
(58) Field of Search ..... 123/41.56, 195 C

(56) References Cited

U.S. PATENT DOCUMENTS 4,907,546 A * 3/1990 Ishii et al. ..... 123/41.56

FOREIGN PATENT DOCUMENTS

JP 1-21399 4/1989

* cited by examiner

*Primary Examiner*—Tony M. Argenbright
*Assistant Examiner*—Katrina B. Harris
(74) *Attorney, Agent, or Firm*—Arent Fox Kintner Plotkin & Kahn, PLLC

(57) ABSTRACT

In an engine operated machine, an engine and a generator formed integrally with each other are covered with a shroud and a fan cover to form a power-generating unit. A head cover of the engine is mounted to protrude from an upper surface of the shroud, and the head cover is resiliently supported on a carrying handle of a case with a rubber bushing positioned therebetween. When the carrying handle is lifted, the weight of the power-generating unit is supported directly by the carrying handle without being applied to the case. Therefore, it is unnecessary to specially reinforce the case, thereby enabling a reduction in weight, and also increasing the degree of freedom of the design such as the shape and material of the case. Thus, when the engine operated machine is transported using the carrying handle, the weight of the engine and the working device can be reliably supported.

5 Claims, 13 Drawing Sheets

ENGINE OPERATED MACHINE

BACKGROUND OF THE INVENTION

1. Field of the Invention

The present invention relates to a portable engine operated machine including an engine and a working device driven by the engine, the engine and the working device being positioned in a sound-insulating case having a carrying handle.

2. Description of the Related Art

A portable engine operated machine is known which includes an engine and a working device positioned in a case made of a synthetic resin, and designed so that it is carried by grasping a carrying handle provided at an upper portion of the case. When the engine operated machine is lifted by grasping the carrying handle, the weight of the engine and the working device, which are heavy members, are applied to a bottom of the case. For this reason, it is necessary to provide the case with sufficient rigidity to prevent the deformation of the case. However, if an attempt is made to enhance the rigidity of the case itself, the weight of the case is increased, resulting not only in an increase in weight of the entire engine operated machine, but also in a limited degree of design choice for the shape and the material of the case.

Therefore, an engine operated machine is known from Japanese Patent Publication No. 1-21399, which is designed such that a pair of front and rear loop-shaped frame members are connected to each other at their upper and lower portions by the carrying handle as well as by a bottom cover, respectively, thereby forming a firm frame, and the engine and working device are supported on the frame, whereby the load is prevented from being applied to a cover covering the frame.

However, the above known machine suffers from the following problem: To support the weight of the engine and the working device, it is necessary for each of the front and rear frame members of the frame, the carrying handle and the bottom cover to have a sufficient rigidity. For this reason, it is difficult to sufficiently reduce the weight of them, and also the shape and material of the frame are limited, resulting in a decreased degree of the design choice.

SUMMARY OF THE INVENTION

Accordingly, it is an object of the present invention to ensure that the weight of an engine and a working device can be supported reliably during transportation of an engine operated machine using a carrying handle, while providing a reduction in weight of the case of the engine operated machine and an increase in degree of freedom in the design.

To achieve the above object, according to a first aspect and feature of the present invention, there is provided an engine operated machine comprising an engine including a shroud for guiding cooling-air, and a working device connected integrally to the engine and driven by the engine. The engine and the working device are positioned or accommodated in a case having a carrying handle at its upper portion, wherein a crankcase, cylinder block and cylinder head of the engine are covered with the shroud, and a head cover of the engine exposed through an opening defined in an upper portion of the shroud, is fixed to the carrying handle of the case.

With the above arrangement, the head cover of the engine exposed through the shroud covering the crankcase, the cylinder block and the cylinder head of the engine, is fixed to the carrying handle of the case. Therefore, when the carrying handle is lifted, the weight of the engine and the working device are supported directly on the carrying handle without being applied to the case. Therefore, it is unnecessary to specially reinforce the case, leading not only to a reduction in weight of the engine operated machine, but also to an increase in degree of freedom of the design such as the shape and material of the case. Moreover, since the head cover of the engine exposed through the opening defined in the upper portion of the shroud, is fixed to the carrying handle, the vertical dimension of the engine operated machine can be reduced without being obstructed by the shroud.

According to a second aspect and feature of the present invention, there is provided an engine operated machine, wherein a support formed integral with the head cover, is fixed to the carrying handle with a vibration-damping member positioned or interposed therebetween.

With the above arrangement, the support formed integrally with the head cover is fixed to the carrying handle with the vibration-damping member interposed therebetween. Therefore, it is possible to reduce the vibration transmitted to the carrying handle.

According to a third aspect and feature of the present invention, there is provided an engine operated machine, wherein an air baffle plate defining an air passage in cooperation with the shroud, is formed integrally on the head cover. The air baffle plate has a spark plug attaching and detaching bore defined therein for attachment and detachment of a spark plug for the engine.

With the above arrangement, the air baffle plate defining the air passage in cooperation with the shroud, is formed integrally on the head cover and hence, the flow of the cooling air within the shroud can be smoothened. Moreover, the spark plug attaching and detaching bore is defined in the air baffle plate and hence, the operation of attaching and detaching the spark plug can be carried out easily, with shroud remaining mounted.

According to a fourth aspect and feature of the present invention, there is provided an engine operated machine, wherein the head cover is arranged, so that it can be attached and detached from the outside of the shroud, with the shroud remaining mounted on the engine.

With the above arrangement, the head cover can be attached and detached from the outside of the shroud, with the shroud remaining mounted on the engine and hence, the maintenance of a valve operating mechanism or the like inside the head cover can be carried out easily.

According to a fifth aspect and feature of the present invention, there is provided an engine operated machine, wherein the working device is a generator, and the cooling air introduced into the case by a cooling fan mounted on the generator, cools the generator, the engine and a muffler, and is discharged to the outside of the case.

With the above arrangement, when the generator is driven by the engine, the cooling fan mounted on the generator is rotated, whereby the cooling air introduced into the case cools the generator, the engine and the muffler, and is discharged to the outside of the case. Therefore, the ventilation of the inside of the case and the cooling of the generator which is a heat generating member, the engine and the muffler, can be carried out by the single cooling fan. Moreover, the engine is covered doubly with the shroud and the case and hence, noise and an air sound emitted by the engine can be reduced effectively.

The above and other objects, features and advantages of the invention will become apparent from the following description of the preferred embodiment taken in conjunction with the accompanying drawings.

BRIEF DESCRIPTION OF THE DRAWINGS

FIGS. 1 to 13 show one embodiment of the present invention, wherein

FIG. 1 is a side view of the entire arrangement of an engine generator.

FIG. 2 is a view taken along a line 2—2 in FIG. 1.

FIG. 3 is a sectional view taken along a line 3—3 in FIG. 2.

FIG. 4 is a sectional view taken along a line 4—4 in FIG. 2.

FIG. 5 is a sectional view taken along a line 5—5 in FIG. 3.

FIG. 6 is a view taken in a direction of an arrow 6 in FIG. 3.

FIG. 7 is a view taken along a line 7—7 in FIG. 5.

FIG. 8 is a sectional view taken along a line 8—8 in FIG. 3.

FIG. 9 is a view taken in a direction of an arrow 9 in FIG. 3.

FIG. 10 is an enlarged view of an area indicated by 10 in FIG. 3.

FIG. 11 is a sectional view taken along a line 11—11 in FIG. 10.

FIG. 12 is an enlarged view of an area indicated by 12 in FIG. 5.

FIG. 13 is an exploded perspective view of the engine generator.

DESCRIPTION OF THE PREFERRED EMBODIMENT

Figure 1:
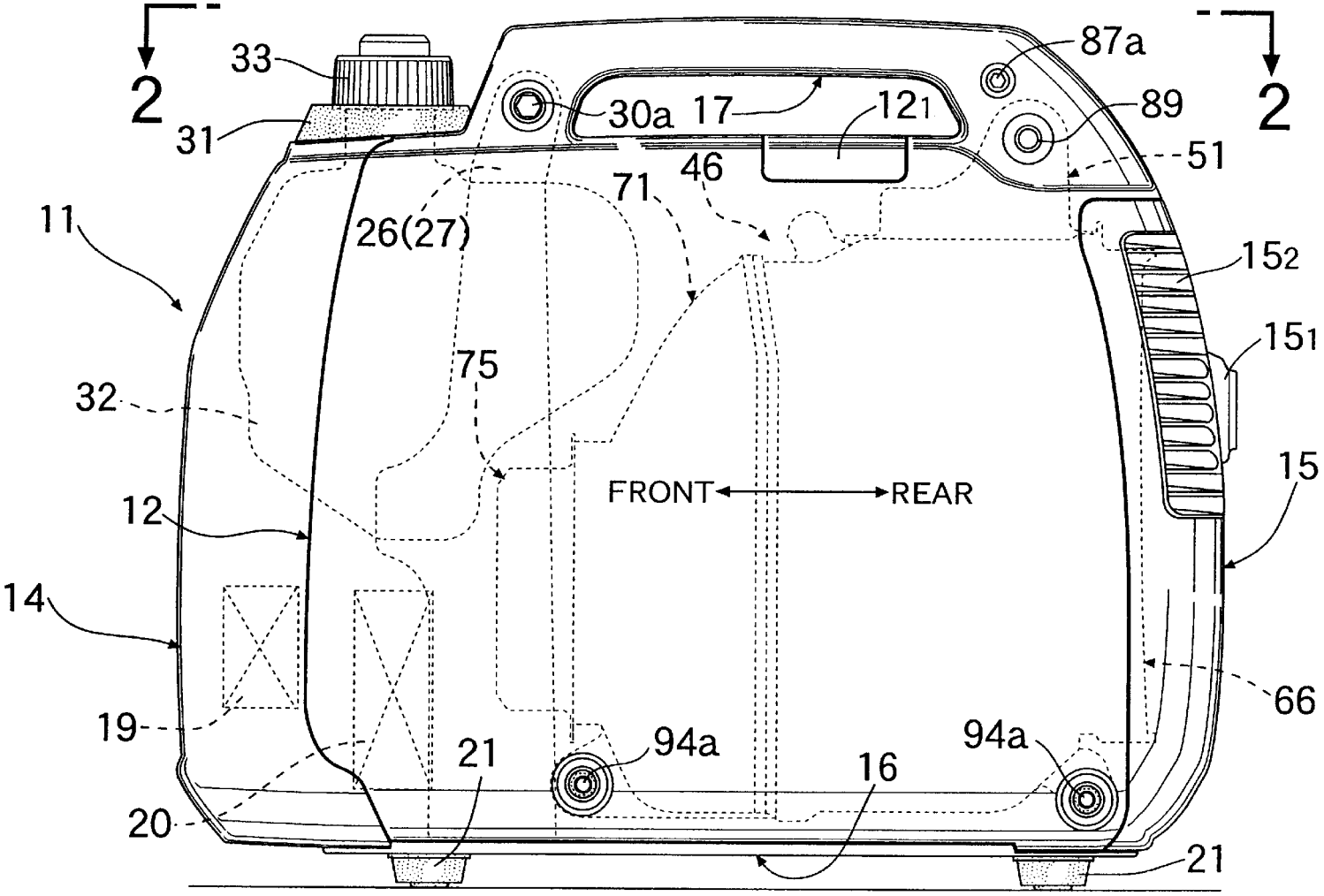
Figure 2:
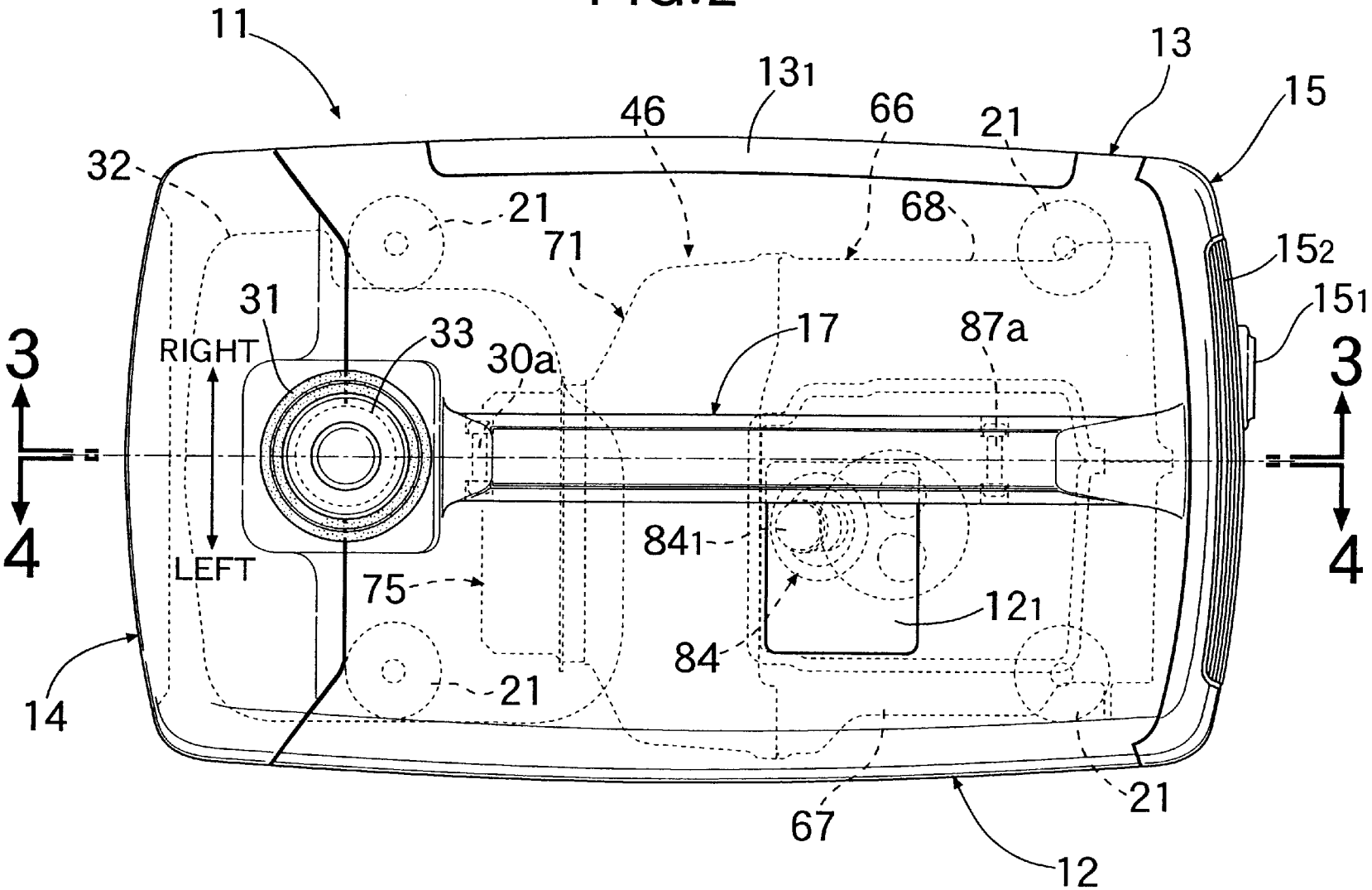
Figure 3:
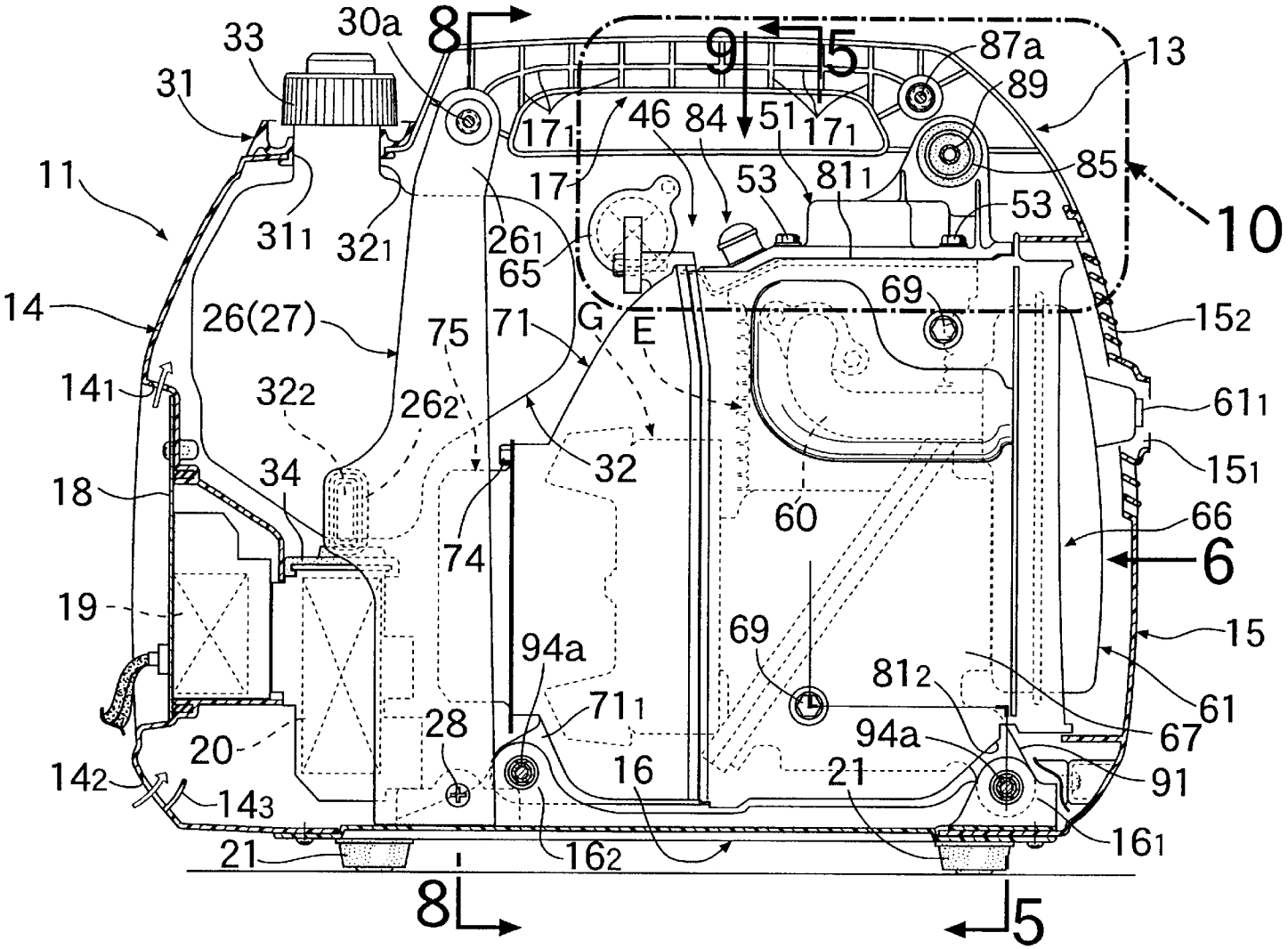

The present invention will now be described by way of embodiments with reference to the accompanying drawings.

FIGS. 1 to 13 show an embodiment of the present invention.

As shown in FIGS. 1 to 4 and 13, a case 11 made of a synthetic resin, which forms an outer profile of an engine generator for generating electric power by driving a generator G with an engine E, is comprised of a left side cover 12, a right side cover 13, a front cover 14, a rear cover 15 and an undercover 16. A carrying handle 17 for carrying the engine generator is provided at upper portions of the left and right side covers 12 and 13 integrally formed therewith, and reinforcing ribs $\mathbf{17}_1$ are formed in a lattice shape within the carrying handle 17 (see FIGS. 3 and 4). A spark plug replacing lid $\mathbf{12}_1$ is formed on the left side cover 12, and slit-shaped cooling-air introducing ports $\mathbf{12}_3$ are defined in the left side cover 12. A maintenance lid $\mathbf{13}_1$ is formed on the right side cover 13. The front cover 14 is provided with an operating panel 18, a control unit 19 mounted at a rear portion of the operating panel 18 for controlling the operations of the engine E and the generator G, and an inverter unit 20 mounted in the rear of the control unit 19 for controlling an output frequency from the generator G. The rear cover 15 is provided with an exhaust gas discharge port $\mathbf{15}_1$ for discharging exhaust gas from the engine E, and a cooling-air discharge port $\mathbf{15}_2$ for discharging cooling-air from the case 11. The undercover 16 is provided with four support legs 21 made of a rubber, which are intended to abut against a ground surface or a floor surface upon placement of the engine generator.

The operating panel 18, the control unit 19 and the inverter unit 20 forming a control system of the engine generator are arranged in a collected manner on the front cover 14. Therefore, not only the length of a wire harness can be shortened, but also the maintenance of the control system can be carried out collectively by only removing the front cover 14.

The case 11 is provided at its front portion with a left reinforcing frame 26 and a right reinforcing frame 27, each of which is formed of FRP into an inverted L-shape. The left reinforcing frame 26 fixed at its lower end to a left side of the undercover 16 by a bolt 28, rises upwards and laterally inwards along an inner surface of the left side cover 12, and has an upward-folded mounting portion $\mathbf{26}_1$ formed at an upper end thereof. The right reinforcing frame 27 fixed at its lower end to a right side of the undercover 16 by a bolt 29, rises upwards and laterally inwards along an inner surface of the right side cover 13, and has an upward-folded mounting portion $\mathbf{27}_1$ formed at an upper end thereof. The left and right frames 26 and 27 form a gate-shape as a whole. The superposed mounting portions $\mathbf{26}_1$ and $\mathbf{27}_1$ are clamped commonly by threadedly fitting a bolt 30*a* inserted therein from the side of the left side cover 12 into an embedded nut 30*b* of the right side cover 13, in a condition in which they have been sandwiched between the left and right side covers 12 and 13 in front of the carrying handle 17 (see FIG. 8).

A seal member 31 made of a rubber is mounted at a location in which the upper surfaces of the left and right covers 12 and 13 and the front cover 14 are joined together. A fuel tank 32 is disposed above the inverter unit 20 and has an oil supply port $\mathbf{32}_1$ closed by a cap 33 which is detachably mounted to extend upwards through an opening $\mathbf{31}_1$ in the seal member 31. The fuel tank 32 is positioned, so that it is not swung, by loosely fitting projections $\mathbf{32}_2$ and $\mathbf{32}_3$ provided on both of the left and right side faces of the fuel tank 32 into fuel tank support portions $\mathbf{26}_2$ and $\mathbf{27}_2$ defined in the left and right reinforcing frames 26 and 27. A lower vibration-damping member 34 made of a rubber, is mounted on an upper surface of the inverter unit 20 and opposed to a lower surface of the fuel tank 32 with a small gap provided therebetween. When the fuel tank 32 supplied with fuel is swelled and deformed downwards by the weight of the fuel, the lower surface of the fuel tank 32 comes into abutment against an upper surface of the lower vibration-damping member 34, whereby the weight of the fuel tank 32 is supported on the inverter unit 20.

In this manner, the fuel tank 32 is supported in such a manner that it is sandwiched from the left and right between the left and right side covers 12 and 13. Therefore, the fuel tank 32 can be demounted by only separating the left and right side covers 12 and 13 from each other without an operation such as detachment of the bolt. Moreover, since the fuel tank 32 is surrounded by the left and right reinforcing frames 26 and 27, the fuel tank 32 can be protected from a shock applied thereto from the outside. The left and right reinforcing frames 26 and 27 do not cover the entire engine generator and hence, a substantial increase in weight is not brought about.

An electrically-operated fuel pump 35 is mounted on an upper surface of an upper portion of the right reinforcing frame 27 for feeding the fuel in the fuel tank 32 to the engine E, and a fuel cock 36 and an engine switch 42 are mounted on an outer side of a lower portion of the right reinforcing frame 27 for cutting off the feeding of the fuel to the engine E. A control knob $\mathbf{36}_1$ for opening and closing the fuel cock 36 passes through the right side cover 13 and is exposed to the outside. In this way, the fuel pump 35 and the fuel cock 36 are supported utilizing the right reinforcing frame 27 and hence, a special support member is not required, thus resulting in a reduction in number of parts. Moreover, the fuel tank 32, the fuel pump 35, the fuel cock 36 and the like comprising a fuel supply system, are supported in a collected manner on the left and right reinforcing frames 26 and 27 rather than on the left and right side frames 12 and 13. Therefore, for the purpose of maintenance of the fuel supply system, the left and right side frames 12 and 13 can be removed easily.

Figure 4:
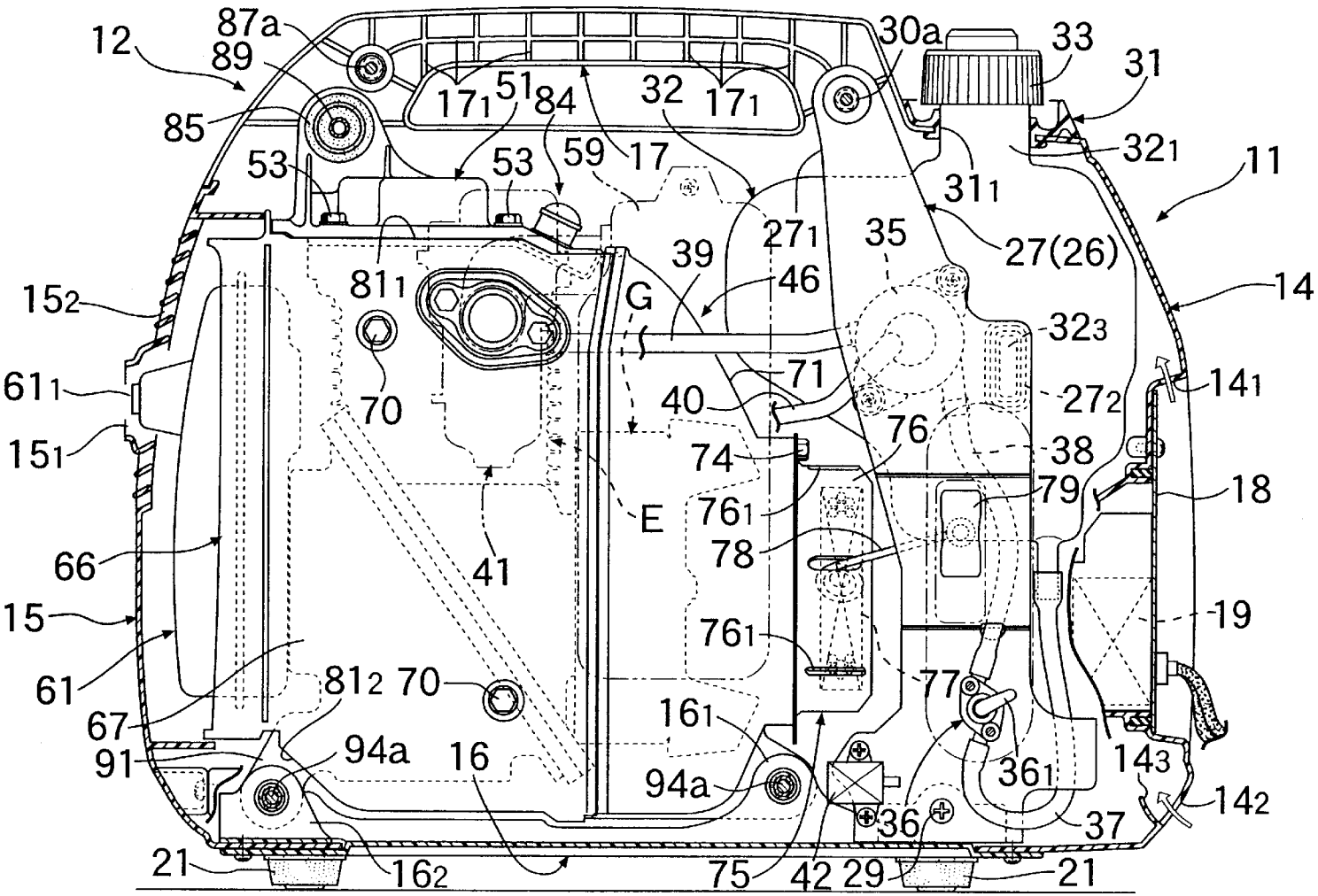
Figure 5:
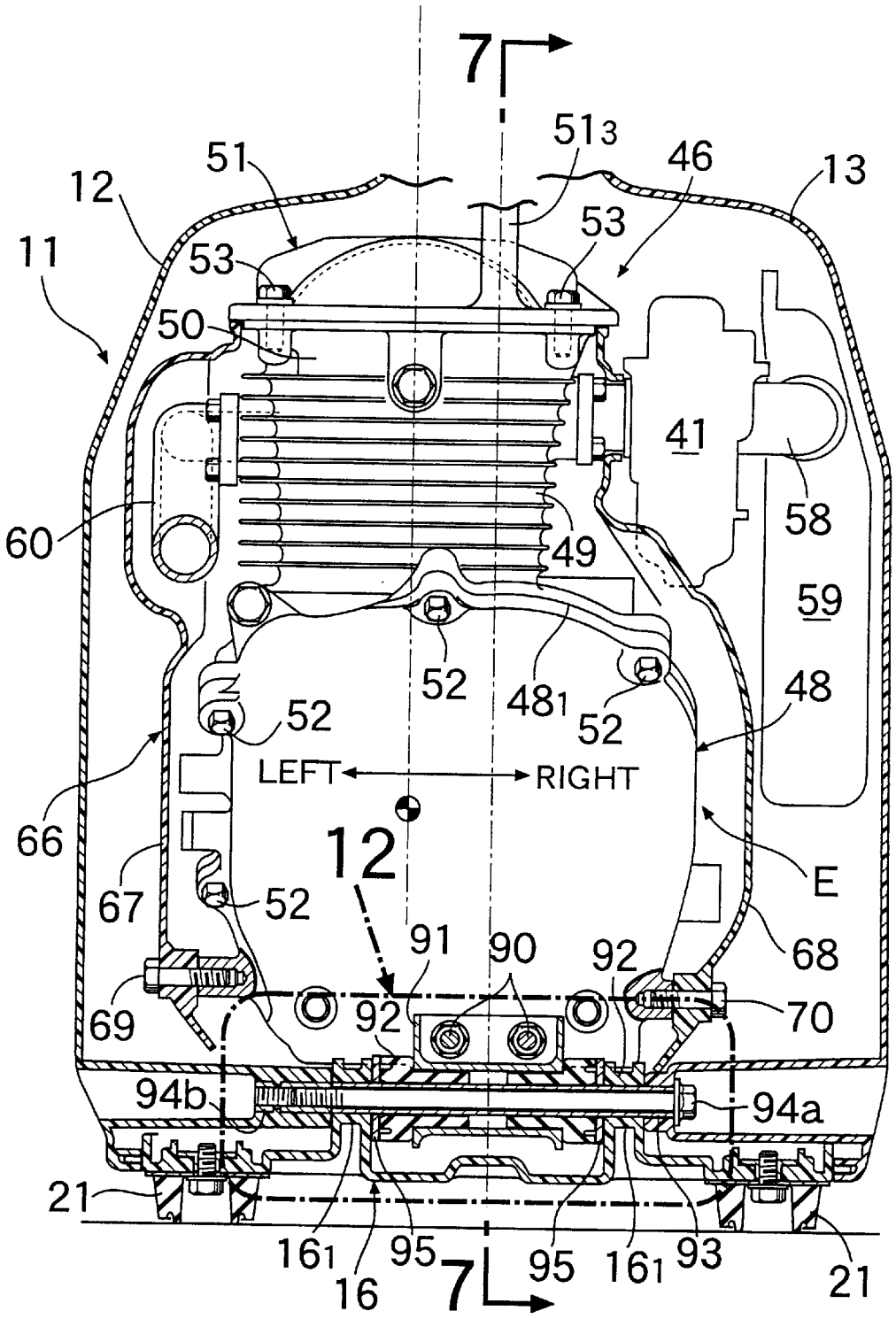

In FIG. 4, reference character 37 is a fuel tube for supplying the fuel from the fuel tank 32 to the fuel cock 36; 38 is a fuel tube for supplying the fuel from the fuel cock 36 to the fuel pump 35; 39 is a fuel tube for supplying the fuel from the fuel pump 35 to a carburetor 41; and 40 is a tube for transmitting the pulsation of an internal pressure in a crankcase of the engine E to a diaphragm (not shown) within the fuel pump 35 to drive the fuel pump 35.

A power generating unit 46 comprising the engine E and the generator G connected integrally to each other, will be described below with reference to FIGS. 5 to 13.

Figure 7:
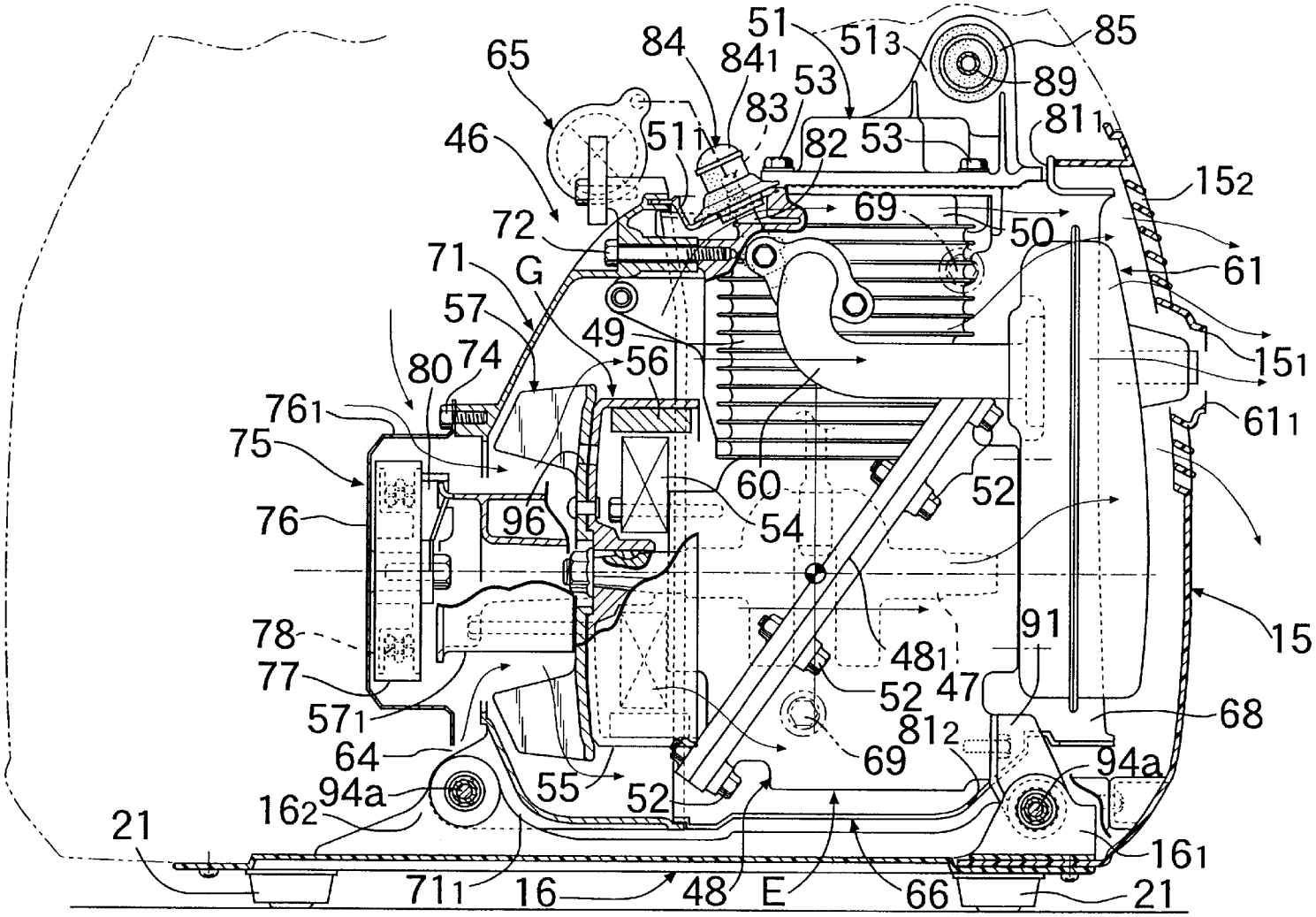
Figure 8:
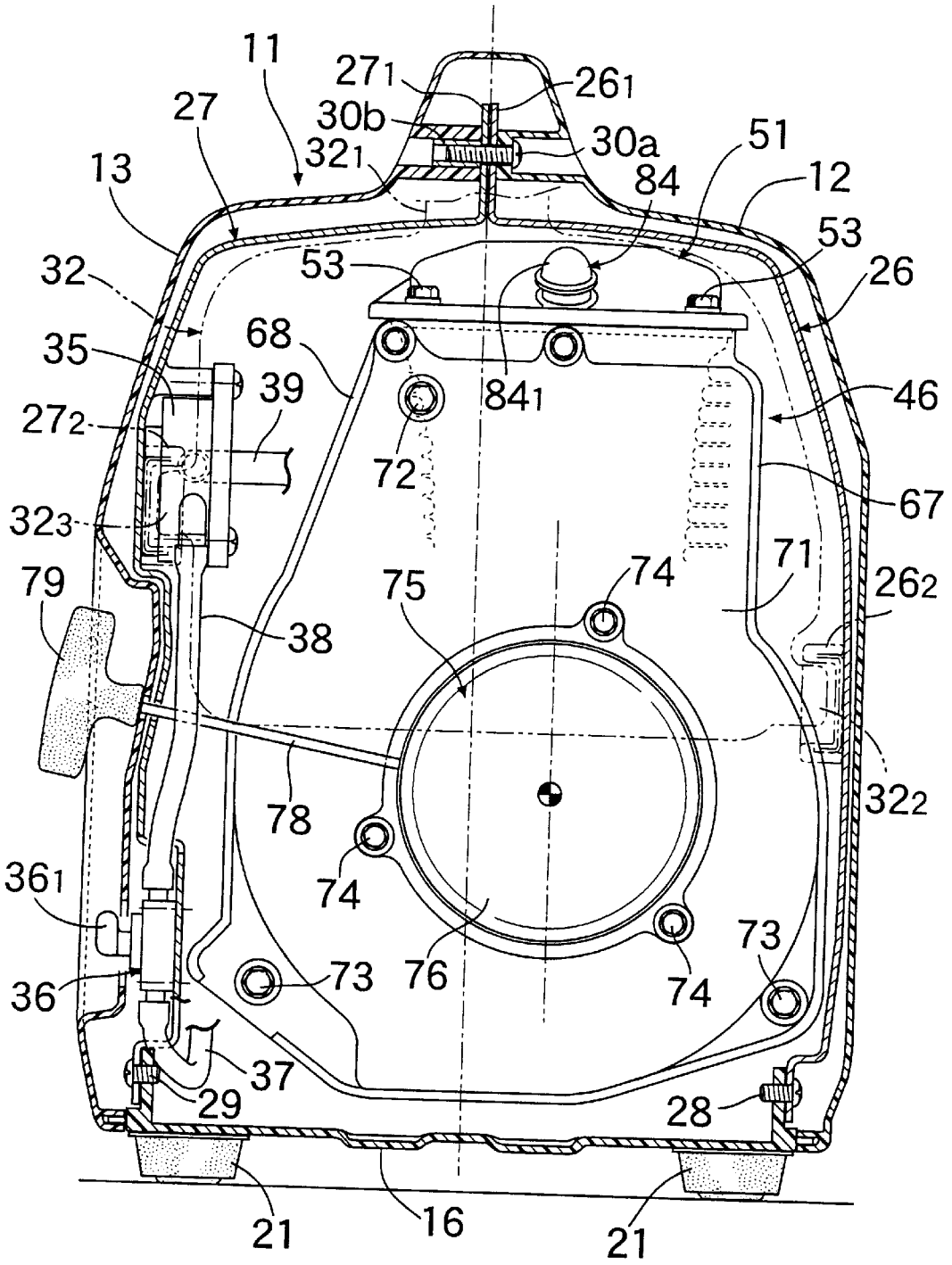

As can be seen from FIG. 7, the 4-cycle, one-cylinder engine E has a crankshaft 47 with an axis disposed longitudinally and includes a crankcase 48, a cylinder block 49, a cylinder head 50 and a head cover 51. The crankcase 48 is divided into two front and rear portions along a parting line $\mathbf{48}_1$ inclined at 45° with respect to the axis of the crankshaft 47. The front portion of the crankcase 48, the cylinder block 49 and the cylinder head 50 are formed integrally with one another. The head cover 51 is detachably coupled to the cylinder head 50 by four bolts 53.

The generator G of an outer rotor type is mounted in a cantilever manner at the axial end of the crankshaft 47 protruding forwards from the crankcase 48, and is comprised of a stator having coils 54 fixed to a front surface of the crankcase 48, and a rotor having permanent magnets 56 which are fixed to an inner peripheral surface of a flywheel 55 fixed to the crankshaft 48, and which are opposed to outer peripheral surfaces of the coils 54. A cooling fan 57 is fixed coaxially to a front surface of the flywheel 55. The carburetor 41 is disposed on a right side of the cylinder head 50 of the engine E, and an air cleaner 59 (see FIGS. 5 and 9) is disposed in front of the carburetor 41 and connected to the carburetor 41 through an intake pipe 58. A box-shaped muffler 61 is connected to a rear end of an exhaust pipe 60 extending rearwards from a left side of the cylinder head 50 of the engine E, and is fixed to a rear surface of the engine E by three bolts 62, 62 and 63 (see FIG. 6).

An exhaust port $\mathbf{61}_1$ is defined in a rear surface of the muffler 61 to face the exhaust gas discharge port $\mathbf{15}_1$ in the rear cover 15 (see FIG. 7).

A shroud 66 made of a synthetic resin and covering the periphery of the engine E is divided into a left shroud half 67 and a right shroud half 68. The left shroud half 67 is fastened to left sides of the crankcase 48 and the cylinder block 49 of the engine E by two bolts 69, 69 (see FIGS. 3 and 5), and the right shroud half 68 is fastened to right sides of the crankcase 48 and the cylinder block 49 of the engine E by two bolts 70, 70 (see FIGS. 4 and 5).

The shroud 66 has front and rear surfaces which open. The outer periphery of the muffler 61 is fitted into the opening in the rear surface with a gap left therebetween, and a fan cover 71 made from aluminum by a diecasting process is fitted to cover the opening in the, front surface. The fan cover 71 covers the generator G and the cooling fan 57 and is fastened at its upper portion to the cylinder head 50 of the engine E by a bolt 72 and at its lower portion to the crankcase 48 of the engine E by two bolts 73, 73 (see FIGS. 7 and 8).

A recoil starter 75 is fixed to a central opening in the fan cover 71 by three bolts 74. The recoil starter 75 includes a reel 77 rotatably carried on a recoil starter cover 76, a cable 78 wound at one end thereof around the reel 77 and passing at the other end thereof through the right reinforcing frame 27 and the right cover 13, a control knob 79 mounted at the other end of the cable 78, and a driving member 80 mounted on the reel 77 and capable of being brought into and out of engagement with a driven member $\mathbf{57}_1$ integral with the cooling fan 57 (see FIGS. 7 and 8). Cooling-air introducing ports $\mathbf{76}_1$ are defined in the recoil starter cover 76, and a cooling-air introducing port 64 is also defined between a lower end of the recoil starter cover 76 and a front lower portion of the shroud 66 (see FIG. 7).

When the cable 78 is drawn by the control knob 79 to rotate the reel 77, the driving member 80 actuated by a cam mechanism (not shown) can be brought into engagement with the driven member $\mathbf{57}_1$ to rotate the cooling fan 57, whereby the crankshaft 47 connected to the cooling fan 57 through the flywheel 55 can be cranked or rotated to start the engine E. When the control knob is released, the driving member 80 is brought out of engagement with the driven member $\mathbf{57}_1$, whereby the reel 77 is revered into the original position under the action of a return spring (not shown), while winding-up the cable 78 therearound.

Figure 9:
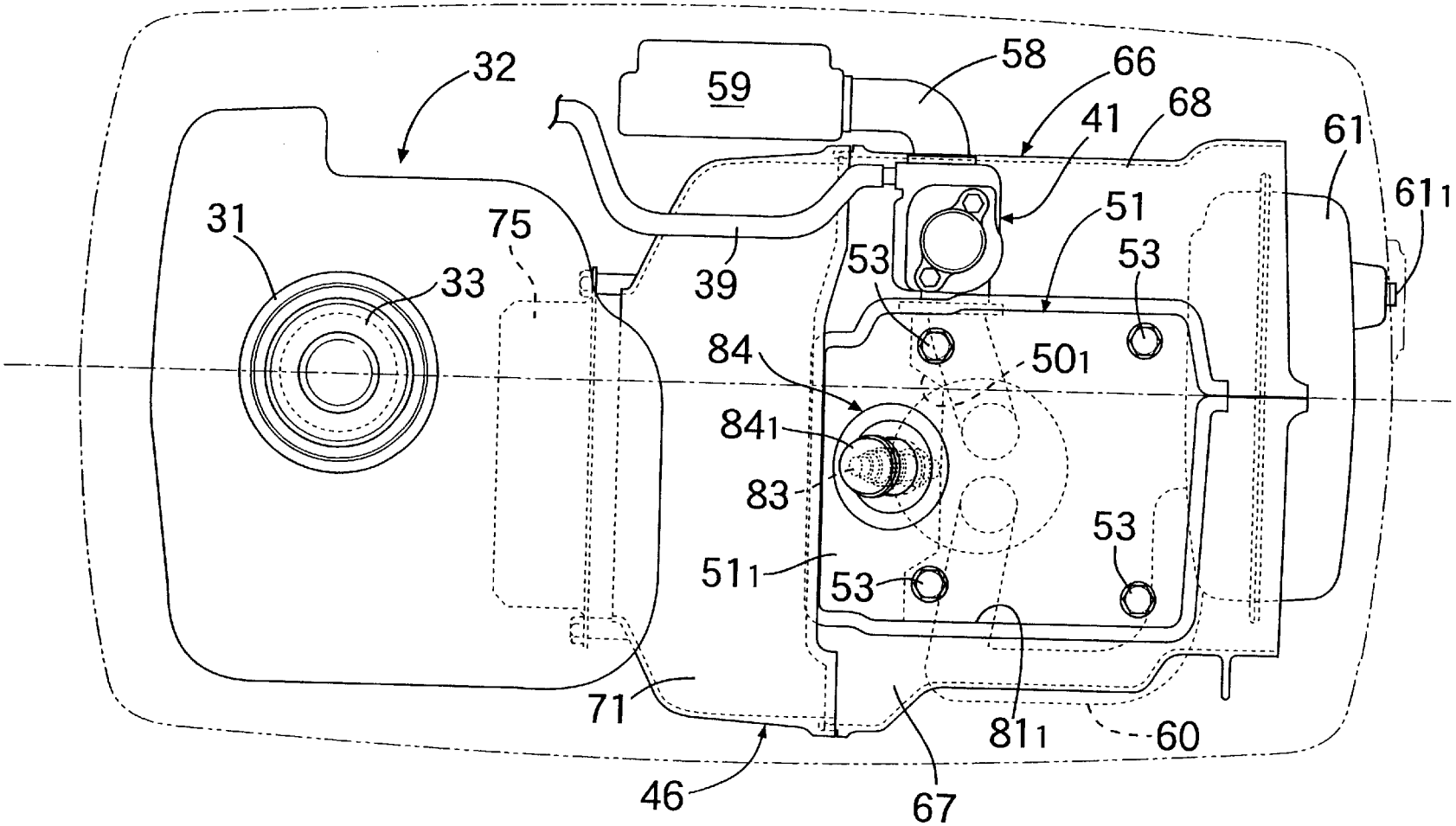
Figure 10:
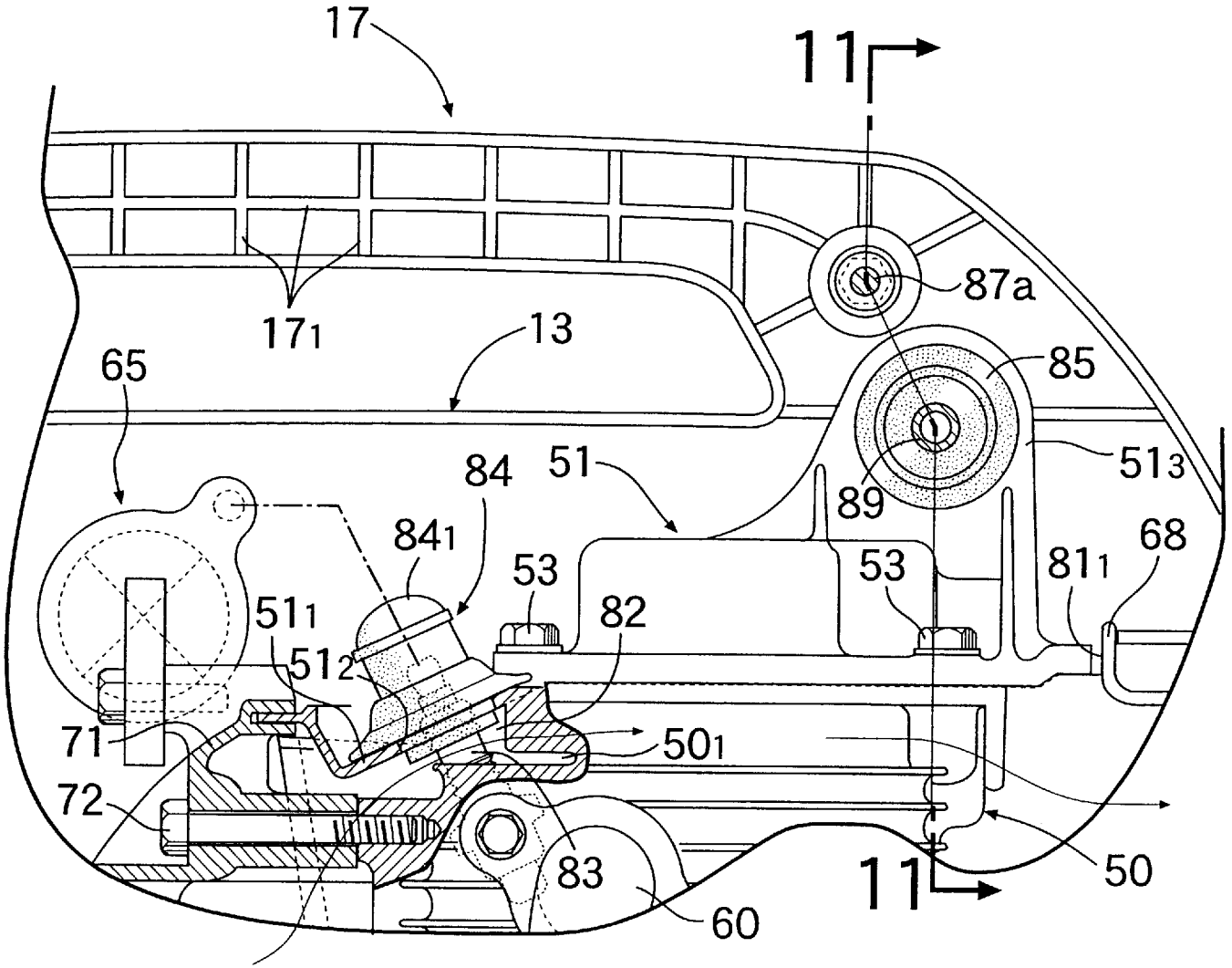

As can be seen from FIGS. 9 and 10, a rectangular opening $\mathbf{81}_1$ is defined, so that it is surrounded by the left shroud half 67, the right shroud half 68 and the fan cover 71, and the head cover 51 of the engine E passes through the opening $\mathbf{81}_1$ and protrudes to the outside of the shroud 66. An air baffle plate $\mathbf{51}_1$ is integrally formed at a front portion of the head cover 51 and extends in such a manner that it is inclined forward and downward. A space forming an air passage 82 (see FIG. 10) is defined between the air baffle plate $\mathbf{51}_1$ and a notch $\mathbf{50}_1$ (see FIG. 9) defined in an upper surface of a front portion of the cylinder head 50. A guide member 84 for attaching and detaching a spark plug 83 to and from the cylinder head 50, is mounted in a spark plug attaching and detaching bore $\mathbf{51}_2$ defined in a central portion of the air baffle plate $\mathbf{51}_1$. An opening in an upper end of the guide member 84 is closed by a detachable cap $\mathbf{84}_1$. An ignition coil 65 is mounted at an upper end of the fan cover 71 in proximity to the spark plug 83.

The guide member 84 faces the spark plug replacing lid $\mathbf{12}_1$ of the left side cover 12 (see FIG. 2) and hence, the maintenance of the spark plug 83 can be carried out through the spark plug attaching and detaching bore $\mathbf{51}_2$ only by opening the spark plug replacing lid $\mathbf{12}_1$ and removing the cap $\mathbf{4}_1$. In addition, if the left and right side covers 12 and 13 are removed, the maintenance of a valve operating mechanism covered with the head cover 51, e.g., the regulation of the tappet clearance and the like can be carried out easily, without removal of the left and right shroud halves 67 and 68 only by removing the head cover 51 exposed from the shroud 66.

Figure 11:
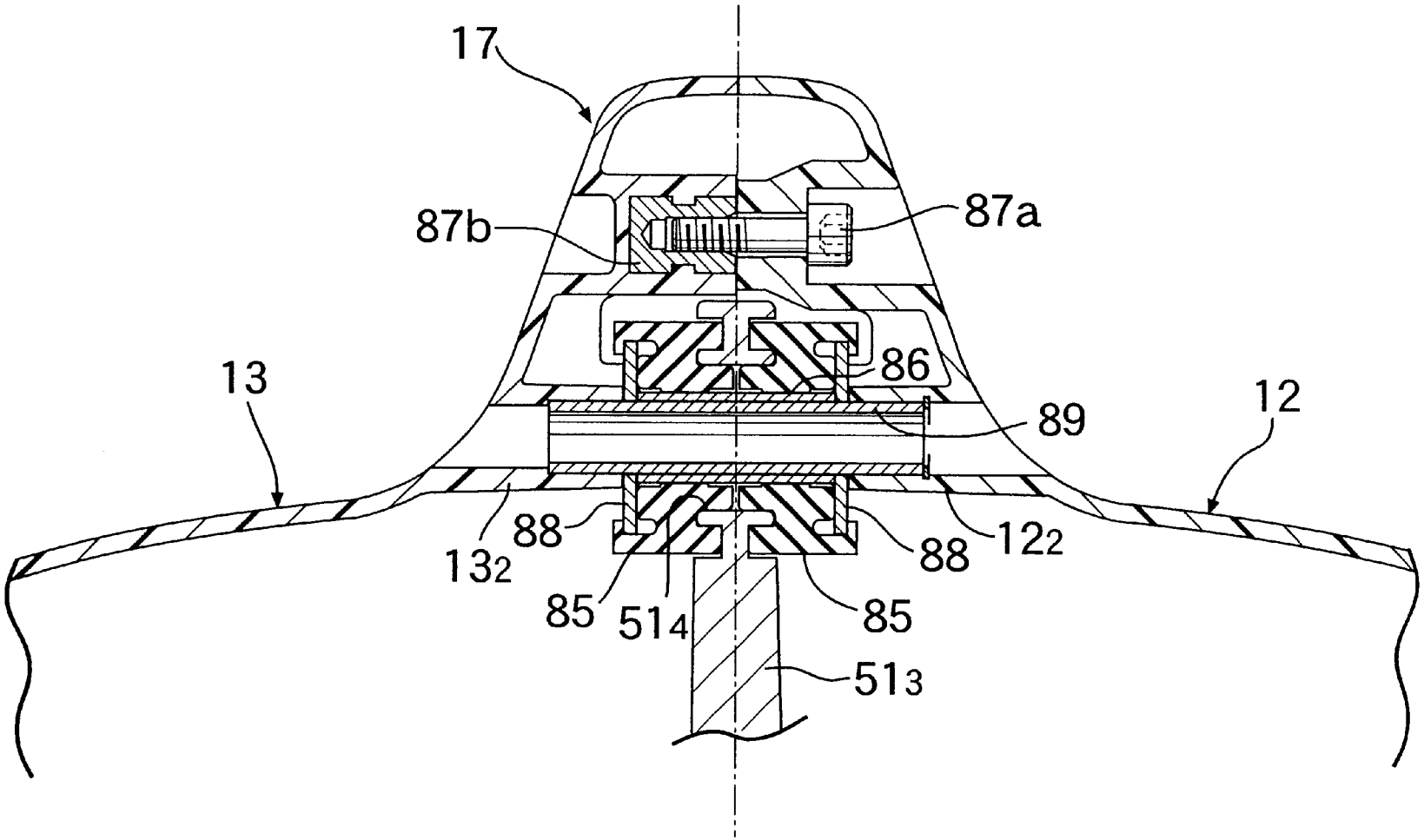

As can be seen from FIGS. 7, 10 and 11, a longitudinally extending plate-shaped support $\mathbf{51}_3$ is projectingly provided on an upper surface of the head cover 51 of the engine. A pair of left and right rubber bushings 85, 85 are fitted into a circular support bore $\mathbf{51}_4$ centrally defined in the support $\mathbf{51}_3$, and a collar 86 is inserted through the inside of the bushings 85, 85. A bolt 87*a* is inserted at a rear portion of the carrying handle 17 from the side of the left side cover 12 and fastened to an embedded nut 87*b* provided in the right side cover 13. Bosses $\mathbf{12}_2$ and $\mathbf{13}_2$ are projectingly provided on the inner surfaces of the left and right side covers 12 and 13 in the vicinity of the bolt 87*a*. Washers 88, 88 are disposed at ends of the left and right rubber bushings 85, 85, and in this state, a connecting pin 89 passing through the washers 88, 88 and the collar 86, is fitted at its opposite ends over the bosses $\mathbf{12}_2$ and $\mathbf{13}_2$ of the left and right side covers 12 and 13, respectively.

Figure 6:
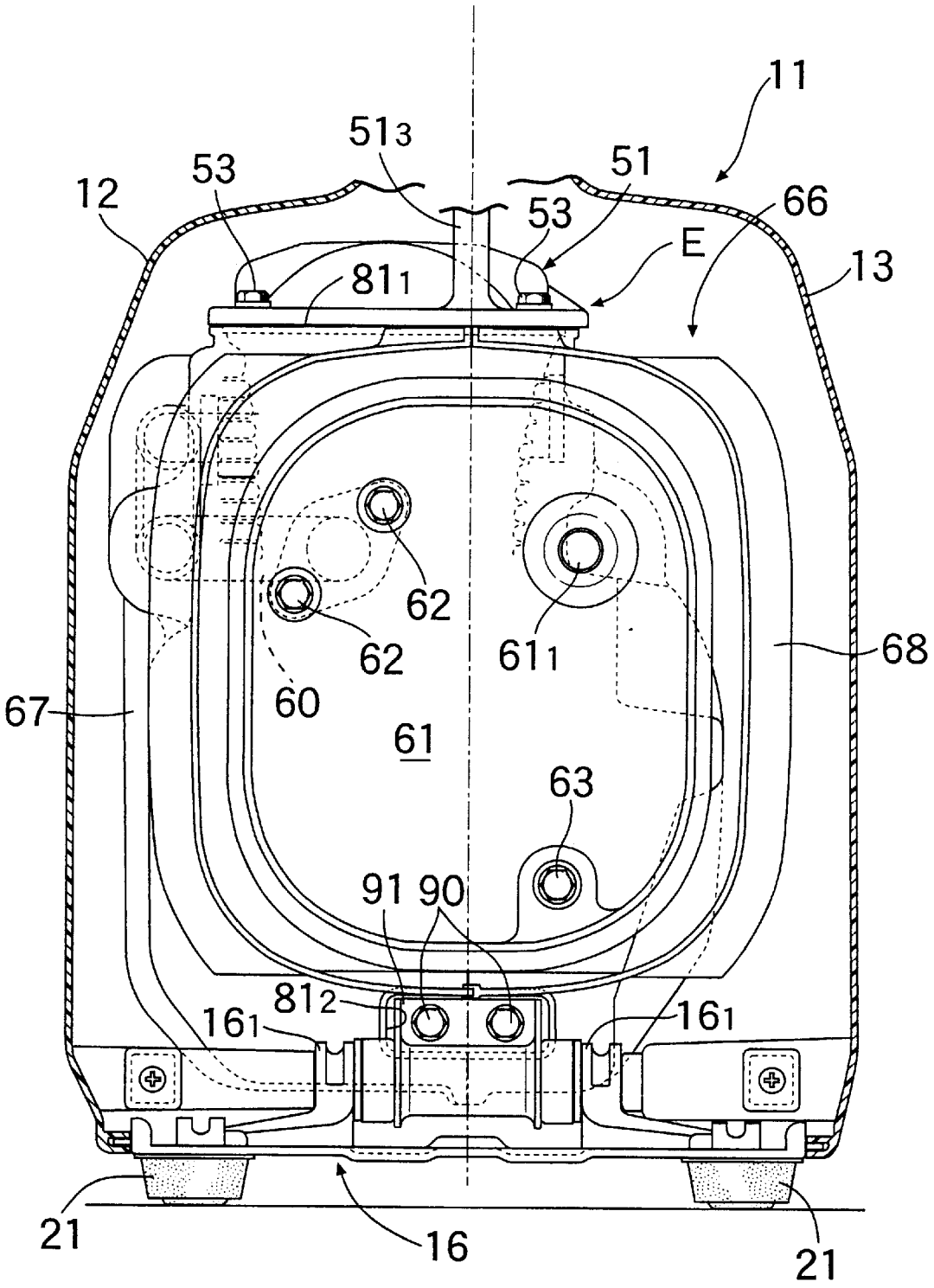
Figure 12:
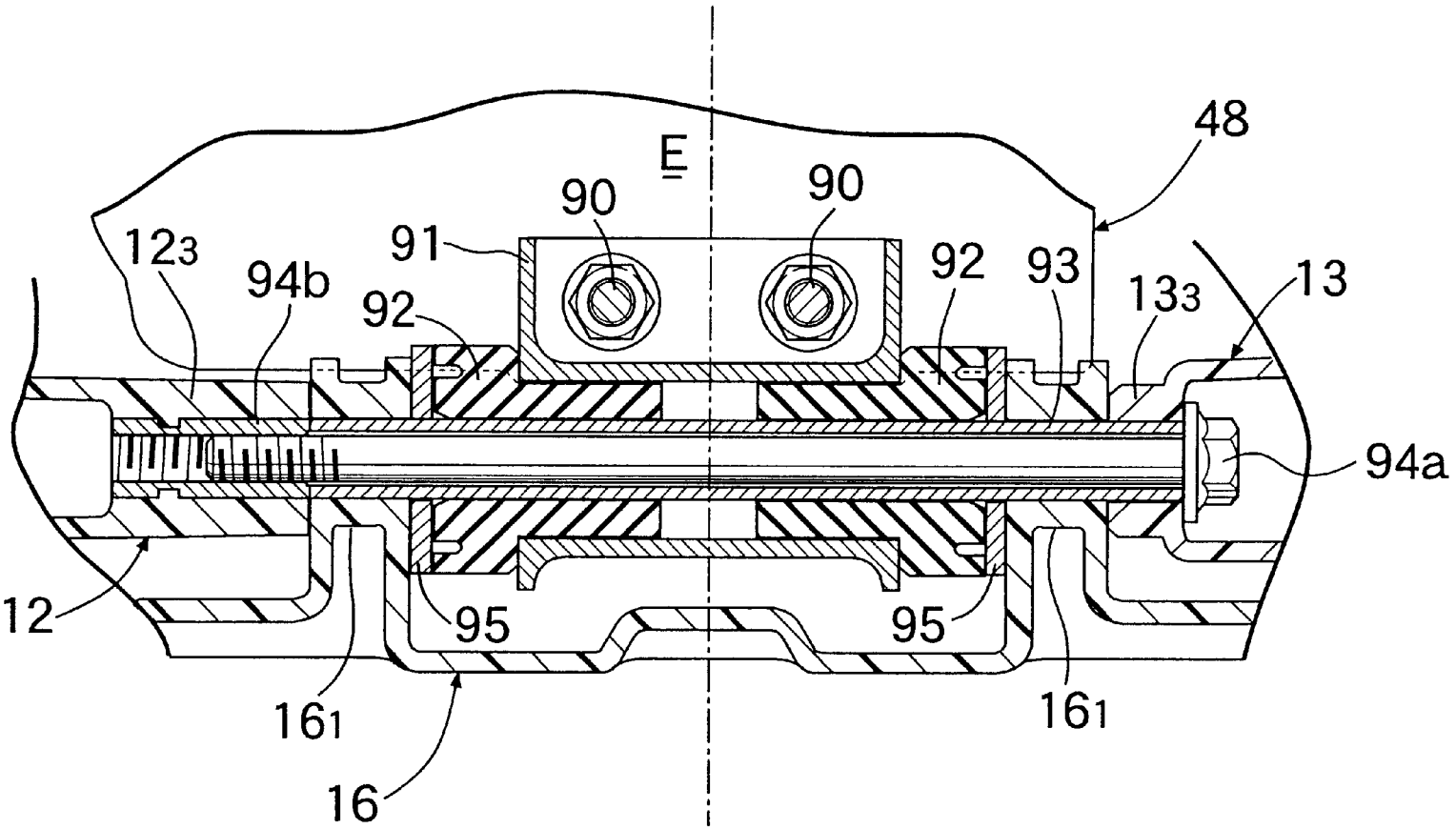
Figure 13:
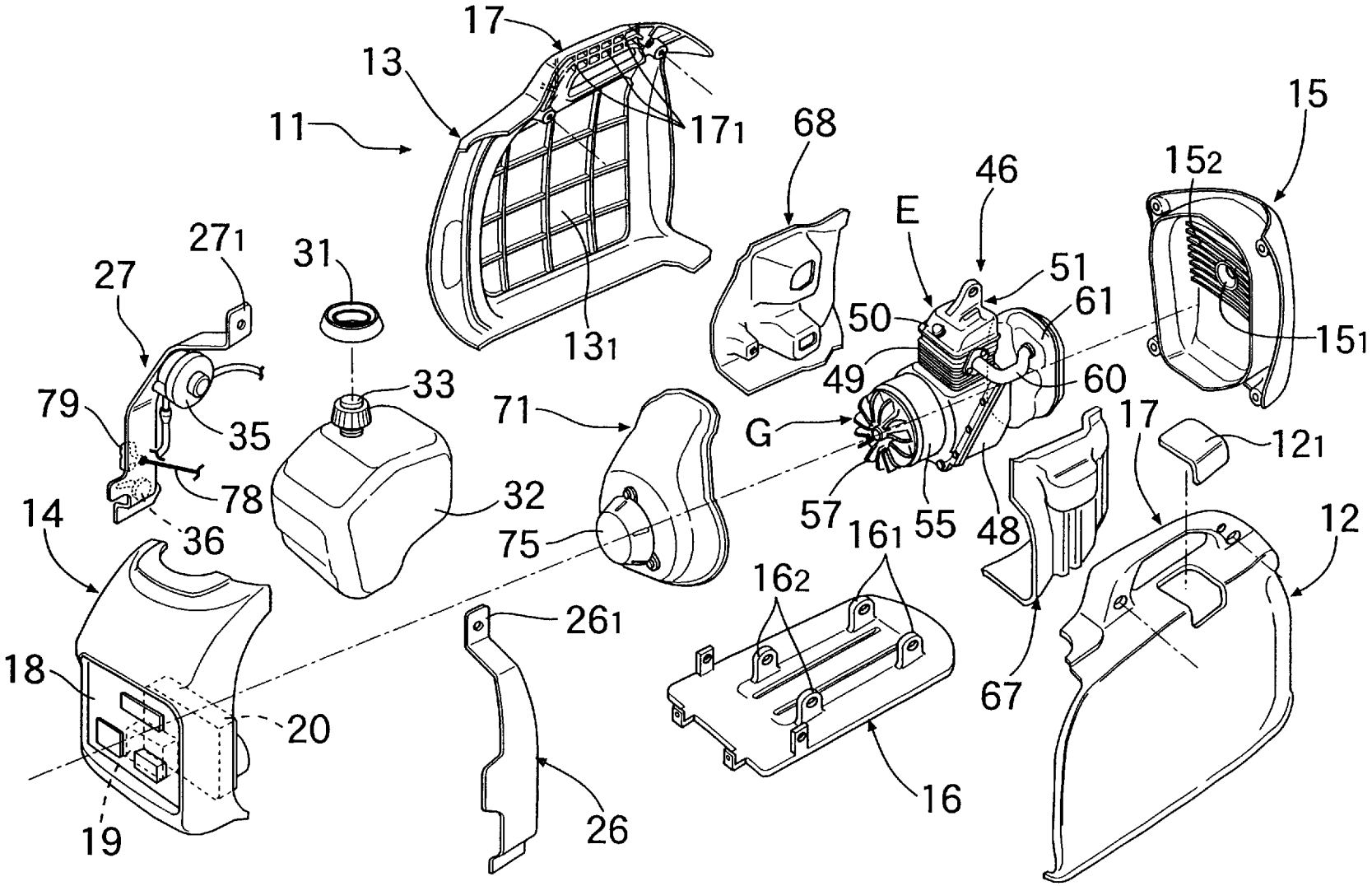

As can be seen from FIGS. 6, 7 and 12, a mounting bracket 91 is fixed to a rear lower portion of the crankcase 48 of the engine E by two bolts 90, 90. The mounting bracket 91 protrudes out of the opening $\mathbf{81}_2$ in the rear lower portion of the shroud 66, and a pair of left and right rubber bushings 92, 92 are fitted over the bracket 91. A pair of left and right mounting ribs $\mathbf{16}_1$, $\mathbf{16}_1$ are formed on an upper surface of a rear portion of the undercover 16 of the case 11, and the rubber bushings 92, 92 are supported on an outer periphery of a central portion of a collar 93 bridging between the pair of mounting ribs $\mathbf{16}_1$, $\mathbf{16}_1$, with a pair of left and right washers 95, 95 interposed therebetween. Thus, the rear lower portion of the engine exposed from the shroud 66 is resiliently supported on the undercover 16 with the rubber bushings 92, 92 interposed therebetween by fastening a bolt 94*a* inserted from the boss $\mathbf{13}_1$ of the right side cover 13 and passing through the collar 93 to an embedded nut 94*b* provided in the boss $\mathbf{12}_3$ of the left side cover 12.

As can be seen from FIG. 7, a mounting bracket $\mathbf{71}_1$ is integrally formed at a lower portion of the fan cover 71 and resiliently supported through a bolt 94*a* on a pair of left and right mounting ribs $\mathbf{16}_2$, $\mathbf{16}_2$ projectingly provided on an upper surface of a front portion of the undercover 16. The structure for supporting the mounting bracket $\mathbf{71}_1$ is the same as the structure for supporting the mounting bracket 91 described with reference to FIG. 5.

In this way, in the power generating unit 46, the head cover 51 located on the upper side is resiliently supported on the carrying handle 17 through the rubber bushing 85, 85; the crankcase 48 located on the rear and lower side is resiliently supported on the undercover 16 through the rubber bushings 92, 92; and the fan cover 71 located on the front and lower side is resiliently supported on the undercover 16 through the rubber bushings 92, 92. Therefore, the weight of the power-generating unit 46 can be dispersed to various portions of the case 11 to prevent a load from being concentrated on a small portion of the case 11. Moreover, the vibration absorbing effect of the rubber bushings 85, 85 and 92 makes it possible not only to prevent the vibration of the engine E from being transmitted to the carrying handle 17, but also to prevent the case 11 from being resonant by the vibration of the engine E.

Particularly, when the carrying handle 17 is lifted to carry the engine generator, most of the weight of the power generating unit 46 including the engine E and the generator G is supported from the support $\mathbf{51}_3$ of the head cover 51 via the rubber bushings 85, 85, the connecting pin 89 and the bosses $\mathbf{12}_2$ and $\mathbf{13}_2$ onto the carrying handle 17 of the case 11. Namely, the power-generating unit 46 is brought into a state in which it hangs down on the carrying handle 17, and thus, it is not necessary to support the weight of the power-generating unit 46 by the case 11 itself. Therefore, the thickness of the case 11 connected below the carrying handle 17 can be reduced, thereby not only providing a reduction in weight of the power-generating unit 46, but also providing a substantial increase in degree of freedom of the design such as the shape and the material of the case 11.

Moreover, since the head cover 51 protruding upwards from the opening $\mathbf{81}_1$ in the upper surface of the shroud 66, is supported on the carrying handle 17, the entire height of the engine generator can be kept to a low level, as compared with a case where the head cover 51 is covered completely with the shroud 66, and the shroud 66 is supported at its upper end on the carrying handle 17.

When the carrying handle 17 is lifted, most of the weight of the power-generating unit 46 is applied to the rear portion of the carrying handle 17 through the head cover 51 of the engine E and for this reason, a bending load is applied to the carrying handle 17 and a portion of the case 11 in the vicinity of the carrying handle 17. However, the load can be dispersed to the front and rear of the carrying handle 17 without the bearing of the load by the left and right side covers 12 and 13, whereby the bending load applied to the carrying handle 17 and a portion of the case 11, in the vicinity of the carrying handle 17 can be alleviated, because the front portion of the undercover 16 supporting the lower portion of the power-generating unit 46, namely, the lower portion of the fan cover 71 and the lower portion of the crankcase 48, is connected to the front portion of the carrying handle 17 through the left and right reinforcing frames 26 and 27 each having a high rigidity.

In addition, the fan cover 71 made from aluminum by a die-casting process, is fastened to the crankcase 48 and the cylinder head 50 in a blocking manner, and the mounting bracket 91 of the crankcase 48 protruding from the shroud 66 covering the outer periphery of the fan cover 71, the crankcase 48 and the cylinder head 50, and the mounting bracket $\mathbf{71}_1$ of the fan cover 71, are supported on the mounting ribs $\mathbf{16}_1$, $\mathbf{16}_1$; $\mathbf{16}_2$, $\mathbf{16}_2$ of the undercover 16 through the rubber bushings 92, 92. Therefore, the power-generating unit 46 can be supported reliably on the undercover 16 without a special support member such as an engine bed.

In a state in which the engine generator has been placed on a ground surface or a floor surface, most of the weight of the power-generating unit 46 is transmitted directly to the undercover 16 having the support legs 21. Therefore, even if the rigidity of the left and right side covers 12 and 13 is set at a lower value, a deformation due to a load is not produced.

Further, in the state in which the engine generator has been placed on the ground surface or the floor surface, the left and right side covers 12 and 13 can be separated from the undercover 16 by only removing the four bolts 30*a*, 87*a*, 94*a*, 94*a*. Therefore, the engine E and the generator G can be exposed without moving the engine generator sideways, whereby the maintenance thereof can be carried out easily.

The generator G corresponds to a working device of the present invention, and the rubber bushing 85 corresponds to a vibration-damping member of the present invention.

The operation concerning the cooling of the engine generator will be described below.

When the engine E is operated to drive the generator G, the cooling fan 57 mounted on the flywheel 55 of the generator G is rotated within the shroud 66. Under a negative pressure generated with the rotation of the cooling fan, external air passes through the cooling-air introducing ports $\mathbf{14}_1$ and $\mathbf{14}_2$ (see FIGS. 3 and 4) in the front cover 14 and is introduced as cooling air into the case 11. Reference character $\mathbf{14}_3$ is a guide for the cooling air introduced through cooling-air introducing port $\mathbf{14}_2$. The cooling air is introduced through the cooling-air introducing ports $\mathbf{76}_1$ defined in the recoil starter cover 76 and the cooling-air introducing port 64 defined below the recoil starter cover 76 into the fan cover 71 and the shroud 66 to cool the generator G, the engine E and the muffler 61 accommodated in the shroud 66. Thereafter, the cooling air passes through the gap between the shroud 66 and the muffler 61 and is discharged through the cooling-air discharge port $\mathbf{15}_2$ to the outside of the case 11. Openings 96 (see FIG. 7) are defined in the flywheel 55 and the cooling fan 57, and the air heated within the generator G is drawn through the openings 96 into the shroud 66.

When the cooling air flows within the shroud 66, the flow of the cooling air within the shroud 66 can be smoothed to enhance the cooling effect, because the air baffle plate $\mathbf{51}_1$ formed integrally on the head cover 51 of the engine E, defines the air passage 82 by cooperation with the fan cover 71 and the left and right shroud halves 67 and 68. Moreover, the cooling air flows directly through the inside of the fan cover 71 made from aluminum by the die-casting process and is coupled to the engine E and hence, the fan cover 71 exhibits a heat sink function to enhance the performance of cooling the engine E.

While the cooling air flows substantially rectilinearly from the front to the rear within the case 11, it cools the generator G which is a heat-generating member, the engine E and the muffler 61. Therefore, it is possible not only to keep the resistance to the flow of the cooling air to enhance the cooling efficiency, but also to keep the number of the cooling fans 57 to one, to reduce the number of parts. Noises emitted by the engine E and the cooling fan 57 are reduced effectively by the shroud 66 and the case 11 which doubly covers the engine E and the cooling fan 57, thereby enabling the quiet operation of the engine generator.

The generator G has been illustrated as the working device in the above-described embodiment, but the present invention is applicable to other working devices such as a compressor, a pump and the like. In addition, the rubber bushings 85, 85 have been illustrated as resilient members in the embodiment, but another resilient member such as a spring and the like may be employed. Further, the carrying handle 17 has been formed as a portion of the case 11 in the embodiment, but the carrying handle 17 may be formed of another member and attached to the case 11.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. An engine operated machine comprising a case having a carrying handle on an upper portion thereof, an engine having a shroud mounted thereon for guiding cooling air, and a working device connected integrally to said engine and driven by said engine, said engine and said working device being positioned in said case, wherein said engine includes a crankcase, a cylinder block and a cylinder head which are covered with said shroud that is accommodated within said case, and a head cover exposed through an opening defined in an upper portion of said shroud, said head cover being fixed to an inside of said carrying handle.

2. An engine operated machine according to claim 1, further including a support formed integrally with said head cover and fixed to said carrying handle, and a vibration-damping member interposed between said support and said carrying handle.

3. An engine operated machine according to claim 1 or 2, further including an air baffle plate integrally formed with said head cover, said air baffle plate defining an air passage with said shroud, said air baffle plate having a spark plug attaching and detaching bore defined therein for providing access for the attachment and detachment of a spark plug of said engine.

4. An engine operated machine according to claim 1 or 2, wherein said head cover can be attached and detached from outside of said shroud with said shroud remaining mounted on said engine.

5. An engine operated machine according to claim 1 or 2, further including a cooling fan mounted on said working device, wherein said working device is a generator, and the cooling air introduced into said case by said cooling fan mounted on said generator cools said generator, said engine and a muffler, and is discharged to the outside of said case.

* * * * *